US005893284A

United States Patent [19]

Hrabal

[11] Patent Number: 5,893,284

[45] Date of Patent: Apr. 13, 1999

[54] LOCK INSERT

[75] Inventor: Lubomír Hrabal, Brno, Czech Rep.

[73] Assignee: I.M.S. Technologies A.S., Brno, Czech Rep.

[21] Appl. No.: 08/836,151

[22] PCT Filed: Jan. 5, 1996

[86] PCT No.: PCT/CZ96/00001

§ 371 Date: Jun. 25, 1997

§ 102(e) Date: Jun. 25, 1997

[87] PCT Pub. No.: WO96/21786

PCT Pub. Date: Jul. 18, 1996

[30] Foreign Application Priority Data

Jan. 9, 1995 [CZ] Czech Rep. ..... 46-95

[51] Int. Cl.[6] ..... E05B 27/06

[52] U.S. Cl. ..... 70/358; 70/375; 70/386; 70/419; 70/493

[58] Field of Search ..... 70/358, 419, 386, 70/493–495, 375, DIG. 37

[56] References Cited

U.S. PATENT DOCUMENTS

| | | | |
|---|---|---|---|
| 2,093,925 | 9/1937 | Pickop . | |
| 2,648,972 | 8/1953 | Diesel | 70/419 |
| 2,682,764 | 7/1954 | Kotab | 70/419 |
| 3,045,468 | 7/1962 | Welch et al. . | |
| 4,669,288 | 6/1987 | Percebois et al. | 70/367 |
| 4,838,061 | 6/1989 | Tai-Seng | 70/419 X |
| 5,138,856 | 8/1992 | Chyun | 70/419 X |
| 5,148,690 | 9/1992 | Wang | 70/419 X |

FOREIGN PATENT DOCUMENTS

| | | |
|---|---|---|
| 485117 | 12/1975 | Australia . |
| 443896 | 8/1991 | European Pat. Off. . |
| 2560915 | 9/1985 | France . |
| 327767 | 10/1920 | Germany . |
| 1563400 | 3/1980 | United Kingdom . |

*Primary Examiner*—Lloyd A. Gall

*Attorney, Agent, or Firm*—Smith, Gambrell & Russell; Beveridge, DeGrandi, Weilacher & Young Intellectual Property Group

[57] ABSTRACT

A lock insert with at least one revolving operating projection (1) for the lock pawl includes a first locking system (2) for axial contact with the frontal end (3) of the key (4) and a second locking system (10) for radial contact with the key (4). The first locking system (2) is formed by a blocking liner (7) with a bottom (5) with an axial carrier cavity (6) for the frontal end (3) of the key (4), and is provided on the outside with at least one operating projection (1) and in its housing with at least one radial opening (8) with a distance element (9) placed therein. The second locking system (10) is formed by a hollow unrevolving liner (11) coaxially enclosing on the outside and on the inside the blocking liner (7) and is provided with radially slidable elevation structures (12) for each distance element (9).

6 Claims, 1 Drawing Sheet

FIG. 1
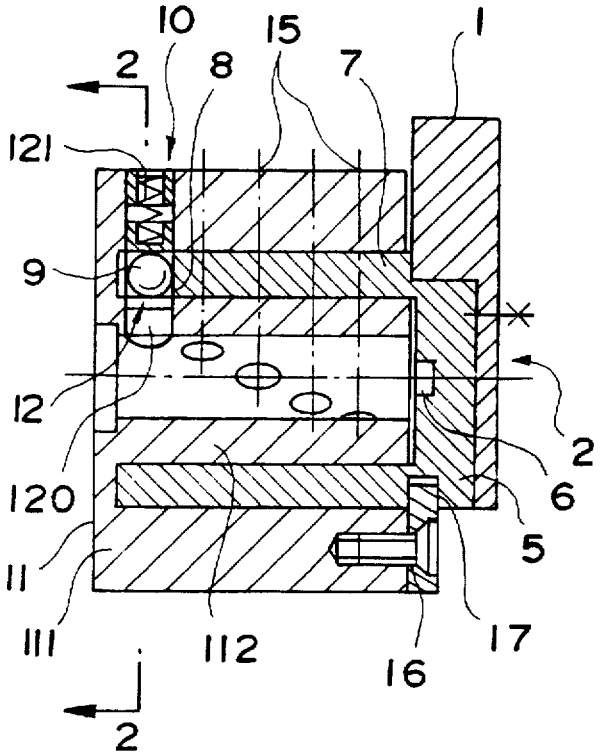
FIG. 2
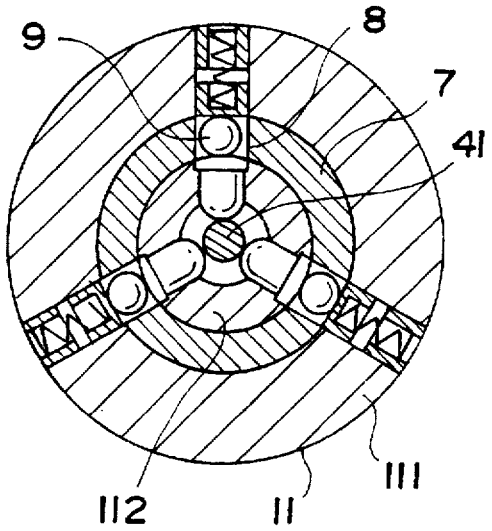
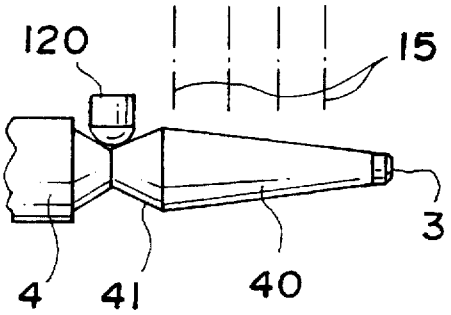
FIG. 4
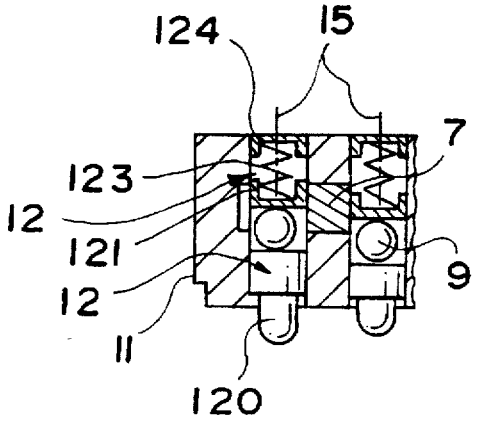
FIG. 3

LOCK INSERT

FIELD OF THE INVENTION

The present invention relates to a lock insert with at least one revolving operating projection for the lock pawl.

BACKGROUND OF THE INVENTION

1. Field of the Invention

At present the most widely spread lock inserts in the Czech Republic are lock inserts of the system FAB or its many modifications. The lock insert is rotatable, i.e. after the appropriate key is inserted, and the respective pawls arranged in a row one after another are unlocked, whereafter the appropriate liner may be rotated and entrain an operating projection for a pawl of a door lock. Such an arrangement of a door lock may be easily overcome by a specialist, especially when using sets of various lamellas. To avoid this, some of the modifications of said lock inserts are provided with two rows of pawls. Even such an arrangement does not prevent sufficiently its trespass.

By using brute force it is either possible to break out known lock inserts or to drill out a set of its blocking pawls and so on. To decrease the chance of breaking out lock inserts, different massive shields are used on the outside of the system of lock inserts. However, they form a solid hold for extending of the whole door frame.

Further improvements have been designed in the aim to secure the lock insert against breakage of its rotatable part by brute force, to make it resistant against unauthorized handling, especially against breakage and drilling out, to prevent its vulnerability to brute mechanical interference, to enhance its resistance against objects emulating keys, and to make it impossible to take unauthorized impressions of the arrangement of the inner locking system and so on.

2. Description of the Prior Art

Said aim has been achieved by a lock insert, which consists of a first locking system for axial contact with the frontal end of the key, where the first locking system is formed by a bottom of a blocking liner having an axial carrier cavity for the frontal end of the key, the liner being provided on the outside with at least one of said operating projections and in its housing with at least one radial opening for passage of a distance element, and of a second locking system for radial contact with the key, where the second locking system is formed by a hollow unrevolving liner substantially and coaxially enclosing, on the outside and on the inside, said blocking liner and which is provided with radially slidable elevation means for each distance element. The disadvantage of this solution consists in the use of a coupling system attached to the blocking liner. During opening the rotatable plate could slip, especially when the mechanism of the mortised lock is damaged or worn out.

DE-A-327 767 discloses a lock insert with a revolving operating projection for a lock pawl, whereby the lock insert comprises a first locking system for axial contact with a frontal end of a key, the first locking system being formed by a blocking liner with a bottom having an axial carrier cavity for the frontal end of the key and being provided on the outside with the operating projection, and a second locking system for radial contact with the key, the second locking system being formed by a hollow unrevolving liner coaxially enclosing from the outside the blocking liner and being provided with a radially slidable elevation means for the distance element.

The main disadvantage of this system is a complicated and demanding (from a production point of view) construction of the key, which consists of a key shank (see claim 1 of D1) and of a teeth part for setting out tumblers of the locking system, the teeth part being rotationally arranged on the key shank. Further on, as the teeth part is flat in shape, all tumblers must be arranged in one plane and all springs push the inserted key (via tumblers) in one direction. This is one of the reasons why the frontal end of the key shank must be pivotally embedded. And not only the key shank, but the teeth part as well are pivotaly mounted, which means that a cumulative tolerance of the axial coincidence of the teeth part and of the key hole is much bigger than that which is necessary in simpler keys construction. This cumulative tolerance, necessary for enabling of both rotational movements, brings about the necessity of bigger tolerance in lengths of the tumblers, ensuing into much smaller variability of keys for the locking system (ie. less combinations for the same number of tumblers and the same length-in the radial direction-of the teeth part). Another disadvantage ensuing from such a construction is a small safety against housebreakers. It is relatively easy for a housebreaker to open such a lock with a vibration means. Namely, when a housebreaker axially vibrates a key having all possible teeth, which all have maximum radial length, and at the same time tries to turn this key, the tumbler which needs the smallest height of the tooth locks in a shear plane of the lock insert. Next, the tumbler needing a bit bigger height of the tooth locks, and so on up to the tumbler with the biggest height of the tooth, and then it is possible to turn the lock insert and open the door.

AU-B-485 117 discloses a pin tumbler cylinder lock key blank, where the blade of said key blank includes a guide section extending lengthwise of said blade and following a helical path. A disadvantage of this solution is as follows: As the key is actually a blade in a helical form, the tumbler holes in the key hole are arranged on a spiral, the shape of which is given by the helical shape of the key blade. The lead of the helix has to be constant to enable the insertion of the helical key through the whole travel of the key hole. The key hole in the blocking liner thus reliably leads the housebreakers to a proper means for opening those locks. The opening of such a lock is, for a person skilled in the art, quite easy.

SUMMARY OF THE INVENTION

It is an object of the present invention to create a lock insert which is resistant to all attempts of unauthorized handling, especially which cannot be broken asunder, drilled out, and which cannot otherwise give in to brute mechanical interference, which is resistant to any object emulating a key, and which would make it impossible to take unauthorized impressions of the arrangement of the inner locking system and so on. Said object is realized by the lock insert according to this invention with at least one revolving operating projection for the lock pawl, having a first locking system, formed by a blocking liner with a bottom and provided on the outside with at least one operating projection and in its housing with at least one radial opening with a distance element placed therein, and a second locking system for radial contact with the key, provided with radially slidable elevation means for each distance element. With the invention, there is an axial carrier cavity for a non-pivotal embedding of the frontal end of the key arranged in the bottom of the blocking liner, the second locking system being formed by a hollow unrevolving liner substantially and coaxially enclosing at least on the outside said blocking liner. In a preferred embodiment of the invention the radial openings for the distance elements are arranged in the blocking liner in at least one helix, this helix arrangement corresponding to the arrangement of the radial slidable elevation means in the large cylindrical annulus and the small cylindrical annulus of the hollow unrevolving liner.

Considering the production, it is advantageous according to the invention, when the distance elements have the form of small balls, the diameter of which comports with the wall thickness of the blocking liner, or the form of cylinders with chamferred edges, the height of which reaches the wall thickness of the blocking liner.

For a reliable and definite function of the lock insert it is advantageous according to the invention if each elevation means for a distance element consists of a pair of shifting pins, the first shifting pin extending into the cavity of the hollow unrevolving liner, to support the distance element, while the second shifting pin is arranged on the other side of the distance element and applies a load to it, wherein the heights of all the first shifting pins of the distance elements mutually differ.

To increase the resistance of the lock inserts against an unauthorized manipulation of the inside of the lock, it is expedient according to the invention if the first shifting pin (in order from the entry side of the lock insert) is as high as possible depending on the critical cross-section of the key.

For different ways of usage of the lock insert, it is possible to double the lock insert by a mirror symmetrical arrangement of the first locking system and the second locking system and to connect them mutually by an axial connection.

DESCRIPTION OF THE DRAWINGS

FIG. 1 is a longitudinal section of the lock insert,

FIG. 2 is a cross-section of the lock insert taken through line 2—2 at the first set of the elevation means and distance elements on the entry side of the lock insert for the key, FIG. 3 is a detailed view of the arrangement and realization of the elevation means for the distance elements, and FIG. 4 is an outline of the realization of the functional part of the key for operating of the lock insert.

DETAILED DESCRIPTION OF THE PREFERRED EMBODIMENTS

The lock insert with at least one rotatable operating projection 1 for a not shown pawl of a not shown lock (FIG. 1), includes a first locking system 2 for axial contact with the frontal end 3 of the key 4 and of a second locking system 10 for radial contact with the key 4. The first locking system is formed by a bottom 5 of a blocking liner 7 with an axial carrier cavity 6 for receiving the frontal end 3 of the key 4. The liner 7 is provided on the outside with at least one said operating projection 1 and in its housing with at least one radial opening 8 for the passage of a distance element 9. The second locking system 10 is formed by a hollow unrevolving liner 11 substantially and coaxially enclosing the blocking liner 7 by its large cylindrical annulus 111 on the outside and by its small cylindrical annulus 112 on the inside of said blocking liner 7. The hollow unrevolving liner 11 is provided with radially slidable elevation means 12 for each distance element 9.

The radial openings 8 for distance elements 9 are arranged in the housing of the blocking liner 7, e.g. in a helix, said helix arrangement corresponding to the arrangement of the radial slidable elevation means 12 in the double housing of the hollow unrevolving liner 11 as shown in FIG. 1. (It should be noted, however, that for simplicity of understanding, FIG. 1 illustrates only one of the three possible helical arrangements shown in FIG. 2.). A longitudinal arrangement of the radial openings 8 (along with the corresponding distance elements 9) is apparent e.g. from the dot-and-dashed lines 15.

The distance elements 9 have the form of small balls, the diameter of which comports with the wall thickness of the blocking liner 7, or the form of (not shown) cylinders with chamfered edges, the height of which matches the wall thickness of the blocking liner 7.

The slidable elevation means 12 for each distance element 9 includes, in the preferred embodiment, a pair of shifting pins 120, 121. The first shifting pin 120 extends into a cavity of the hollow unrevolving liner 11 and supports the distance element 9, while the second shifting pin 121, arranged on the other side of the distance element 9, applies a load to the distance element 9, wherein the heights of all first shifting pins 120 and of the distance elements 9 mutually differ. As it will be disclosed further on, it is expedient, that the first shifting pin 120 from the entry side of the lock insert extends into the lock insert as far as possible, as it is displayed in detail in FIG. 3, where also one of many possible embodiments of the shifting pin 121 loaded by a spring 123 is specifically marked out, the spring 123 being arranged under a plug 124. The free frontal end of the first shifting pin 120, extending into the cavity of the small cylindrical annulus 112 of the hollow unrevolving liner 11, is adjusted to the form of a spherical cap or a truncated cone or the like.

The blocking liner 7 and the hollow unrevolving liner 11 are axially mutually connected. Implementation of said connection is effected, e.g., by means of a packing piece 16, which is fastened to the rear face of the unrevolving hollow liner 11 and extends into a circumferential groove 17, formed on the outer surface of the blocking liner 7.

The lock insert may be doubled by adding a second locking system to the described first locking system 2 in a reflected arrangement (mirror arrangement), both systems 2 and 10 being mutually connected by a not shown axial connection.

A uniform key 4 for the described lock insert is of a radially symmetric configuration except for the, frontal end 3 which has a shape, corresponding to the shape of the axial carrier cavity 6 in the rotatable plate 5. The functional side has the form of a truncated cone 40 for radial contact with the second locking system 10, while said truncated cone 40 is provided with one or more circumferential conical recessions 41 or stages for radial shifting and implementation of the appropriate terminal lift of the slidable elevation means 12 of the distance elements 9 in the radial openings 8 of the blocking liner 7.

The function of the lock insert according to the invention is as follows:

The appropriate key 4 (FIG. 4), being inserted with its frontal end 3 in the axial direction into the cavity of the small cylindrical annulus 112 of the hollow unrevolving liner 11, gradually, in consequence of the conical and eventually gradual form of its functional side, radially pushes away the slidable elevation means 12 of the distance elements 9 in the radial openings 8 in the housing of the blocking liner 7 into various positions, while however, not all distance elements 9 get into the positions, where their appropriate tangents would fit with the surfaces on the inner and outer side of the housing of said blocking liner 7. This happens after the key 4 is fully inserted following its appropriate angular turning and fitting with its frontal end 3 into the axial carrier cavity 6 in the bottom 5 of the blocking liner 7. If the appropriate key 4 is used, then, not until reaching this position, said elevation means 12 get into the beforehand determined positions, by which the distance elements 9, which are operated by them, are placed in the radial opening precisely lined-up with the thickness of the housing of the blocking liner 7. The adjacent faces of the first shifting pins 120 and the second shifting pins 121 of the elevation means 12, adjacent to the distance elements 9, are positioned in this way towards the surfaces of said housing of the blocking liner 7. Thereby, the blocking liner 7 is unblocked, because neither said adjacent ends of the first shifting pins 120 nor the ends of the second shifting pins 121, which previously acted as arresting elements against turning of the blocking liner 7, are in an engagement with the radial openings 8 for the distance elements 9.

By turning of the key 4 the torque is transferred from its frontal end 3 to the bottom 5 of the blocking liner 7 by means of the axial carrier cavity 6. If the distance elements 9 and the adjacent first shifting pins 120 and the second shifting pins 121 are in the due positions, the blocking liner 7 may rotate together with the operating projection 1 and through this projection 1 affect the (not shown) lock pawl. Hereby the first shifting pins 120 and the second shifting pins 121 of the elevation means 12 slide on against the walls of the housing of the blocking liner 7 and, when passing by any of the radial openings 8, they remain henceforth at an adequate distance according to the distance elements 9 centered in the radial openings 8.

If the above described state for operating the lock insert is not achieved, e.g. when using an inappropriate key 4, the slidable elevation means 12 of the distance elements 9 remain in the position, in which either the first shifting pins 120 or the second shifting pins 121 of the slidable elevation means 12 remain fitted in the radial openings 8 and henceforth act as an obstacle against turning of the blocking liner 7. In that case, although the engagment of the frontal end 3 of the key 4 or of its substitute with the axial carrier cavity 6 is achieved, the blocking liner 7 with the operating projection 1 will not be turned.

On an attempt to operate the lock insert by using an arrangement of various jigs, insuperable difficulties arise, especially because the first shifting pins 120 of the slidable elevation means 12 of the distance elements 9 are seated in a helix arrangement and because they are not lined-up. If, as indicated above, the first shifting pin 120 from the entry side of the lock insert extends into the lock cavity as far as possible, what corresponds e.g. also to the appropriate cross-section of the recession 41 of the functional side of the key 4, said arrangement results in a substantial narrowing of said entering opening to prevent possible unauthorized manipulation of the inside of the lock insert.

I claim:

1. A lock insert for operating a lock pawl, comprising:

a rotatable blocking liner connectable to a lock pawl, the blocking liner having a bottom defining therein a non-circular cavity for receiving a frontal end of a key along an axial direction of the blocking liner, and for conveying torque from a frontal end of a key to rotate the blocking liner, the cavity having an end face for facing a key, and a cylindrical housing configured to be free of contact with a key and defining therein a plurality of first radial openings, the first radial openings being arranged along a length of the cylindrical housing in a first helix;

an unrevolving liner including at least a first annulus positioned at an outside of the cylindrical housing, the first annulus defining therein a plurality of first cavities, such that a position of each of the first cavities corresponds to a position of a first radial opening when the blocking liner is in a locked positioned;

a plurality of first distance elements, each of the first distance elements having a thickness corresponding to a thickness of the cylindrical housing; and a plurality of first elevation means for forcing the first distance elements away from the first radial openings defined in the cylindrical housing, each of the first elevation means being positioned within a first cavity of the first annulus, each of the plurality of first distance elements and the plurality of first elevation means being arranged such that, when the blocking liner is in a locked position, each first distance element is urged by a first elevation means away from a first radial opening, to thereby prevent rotation of the blocking liner relative to the unrevolving liner, and when the blocking liner is in an unlocked position, each first distance element is maintained in a first radial opening so as to allow rotation of the blocking liner relative to the unrevolving liner.

2. A lock insert as recited in claim 1, wherein the distance elements are spherical.

3. A lock insert as recited in claim 1, wherein, when the blocking liner is in a locked position, each first distance element is urged by a first elevation means away from a first radial opening toward the inside of the cylindrical housing.

4. A lock insert as recited in claim 1, wherein the unrevolving liner including a second annulus positioned at an inside of the cylindrical housing, the second annulus defining therein a plurality of first cavities, such that a position of each of the first cavities of the second annulus corresponds to a position of a first radial opening when the blocking liner is in a locked positioned, and when the blocking liner is in a locked position, each first distance element is urged by a first elevation means away from a first radial opening toward a first cavity defined in the second annulus.

5. A lock insert as recited in claim 4, wherein each first elevation means includes a plug positioned in a first cavity defined in the first annulus;

a first shifting pin positioned at least partially in a first cavity defined in the first annulus;

a spring positioned between the plug and the first shifting pin, for urging the first shifting pin toward a first cavity defined in the second annulus; and a second shifting pin positioned at least partially in a first cavity defined in the second annulus, a first distance element being positioned between the first shifting pin and the second shifting pin.

6. A lock insert as recited in claim 1, wherein the cylindrical housing further defines therein a plurality of second radial openings, the second radial openings being arranged along a length of the cylindrical housing in a second helix, the first annulus of the unrevolving liner further defines therein a plurality of second cavities, such that a position of each of the second cavities corresponds to a position of a second radial opening when the blocking liner is in a locked position; and further including a plurality of second distance elements, each of the second distance elements having a thickness corresponding to the thickness of the cylindrical housing; and a plurality of second elevation means for forcing the second distance elements away from the radial openings defined in the cylindrical housing, each of the second elevation means being positioned within a second cavity defined in the first annulus, each of the plurality of second distance elements and the plurality of second elevation means being arranged such that, when the blocking liner is in a locked position, each second distance element is urged by a second elevation means away from a second radial opening, to thereby prevent rotation of the blocking liner relative to the unrevolving liner, and when the blocking liner is in an unlocked position, each second distance element is maintained in a second radial opening so as to allow rotation of the blocking liner relative to the unrevolving liner.

* * * * *